United States Patent [19]

Fort et al.

[11] Patent Number: 4,611,650

[45] Date of Patent: Sep. 16, 1986

[54] SOCKET CORE SUPPORT DEVICE FOR CENTRIFUGAL PIPE CASTING MACHINE

[75] Inventors: Pierre Fort, Nancy; Michel Pierrel, Pont a Mousson, both of France

[73] Assignee: Pont-a-Mousson S.A., Nancy, France

[21] Appl. No.: 609,247

[22] Filed: May 11, 1984

[30] Foreign Application Priority Data

May 11, 1983 [FR] France ..... 83 07939

[51] Int. Cl.[4] ..... B22D 33/04

[52] U.S. Cl. ..... 164/298; 164/302; 164/340

[58] Field of Search ..... 164/302, 298, 286, 340, 164/339, 137, 114, 397; 425/425, 435

[56] References Cited

U.S. PATENT DOCUMENTS 1,983,075 12/1934 Geisler ..... 164/302
3,004,314 10/1961 Beyer ..... 164/302 X
3,612,162 10/1971 Michel ..... 164/340 X

FOREIGN PATENT DOCUMENTS 1005813 9/1965 United Kingdom ..... 164/302
850290 7/1981 U.S.S.R. ..... 164/286

*Primary Examiner*—Nicholas P. Godici
*Attorney, Agent, or Firm*—Sughrue, Mion, Zinn, Macpeak and Seas

[57] ABSTRACT

A head assembly for a socket core 3 for the centrifugal casting of iron pipes including a seat 24 for supporting the core in a socket end 6 during casting, and a head 50 for positioning the seat and core in a chill-mould 1. The head is separable from the seat and includes dogs 20 pivotable around joints 21 by a jack 13, the dogs having end claws 22 arranged to fit into a recess 51 of the seat to enable a core to be handled and fitted without the dogs directly gripping the core, thus avoiding the risk of the core being damaged during fitting.

4 Claims, 7 Drawing Figures

SOCKET CORE SUPPORT DEVICE FOR CENTRIFUGAL PIPE CASTING MACHINE

BACKGROUND OF THE INVENTION

This invention relates to a support device for fitting a socket core on an end of a chill-mould for centrifugally casting iron pipes.

Such a core support or "head" is described in U.S. Pat. No. 3,612,162 and French Pat. No. 2,053,388, and is mounted on the end of an articulated arm so as to be retractable away from the front of a centrifugal chill-mould and out of the path of the cast pipe when it is axially extracted from the mould. The head includes a metal seat that acts as a direct chaplet for the sintered sand socket core, and articulated dogs for gripping the core on the inside to insert it into a recess in the end of the mould. The head contains a jack for actuating the dogs between a core gripping position and a retracted position.

This technique of radial interior dogs directly contacting the interior of the sand core requires the repeated radial adjustment of the dogs to prevent them from becoming too solidly inserted in the sand core's interior, and the periodic readjustment of the dogs' position according to the diameter of the annular core's interior cavity, which has wide dimensional tolerances due to the wear of the core mould box resulting from abrasion by the sand.

Furthermore, the articulated levers on the dogs are actuated by a jack to engage the dogs in the sand core's interior. The jack's stroke must be carefully controlled to prevent the dogs from entering the core's interior too deeply, creating the risk of breaking the relatively fragile sand core.

Finally, due to the risk of the dogs going too far into the sand cavity, and the ensuing commencement of a rupture of the core, the use of a dog core support such as described in the two patents above is limited to relatively light weight socket cores; for example, those for pipes with an interior diameter of 150 mm.

SUMMARY OF THE INVENTION

The object of this invention is to overcome these difficulties of radial adjustment of the dogs and adjustment of the stroke of the actuating jack for the dog support levers, in order to reduce the risk of core breakage by providing a core support dog usable for all diameters, notably for socket cores of pipes whose interior diameters exceed 150 mm.

The support device for a socket core according to the invention includes a metal seat for supporting and holding the core in the socket end of the chill-mould during casting, and a head for positioning the seat and core in the mould, the seat being separable from the head and having means for automatically fastening to the mould during casting with the head separated from the seat. The core gripping means comprises dogs mounted on the head and directly engaging the core support seat. The dogs are distributed around the axis of the seat and the head, articulated on axes orthogonal to the head axis, and are actuated by a coaxial jack on the head to grip the seat and separate it from the head by retracting the dogs.

As a result of this arrangement the gripping and coupling dogs engage the metal seat instead of directly engaging the sintered sand socket core as in the patents above. Difficulties stemming from the dogs becoming encrusted in the sand core are thus eliminated.

DETAILED DESCRIPTION OF THE PREFERRED EMBODIMENT

Figure 1:
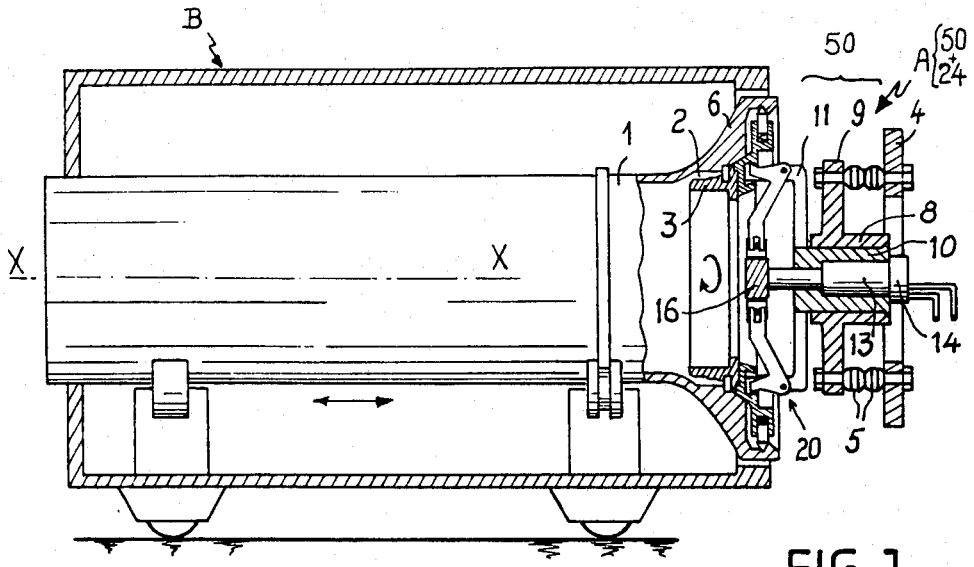
FIG. 1 is a half-sectional, longitudinal side view, with some parts extracted, of a centrifugal casting machine for iron socket pipes, fitted with a core support device according to the invention.
Figure 7:
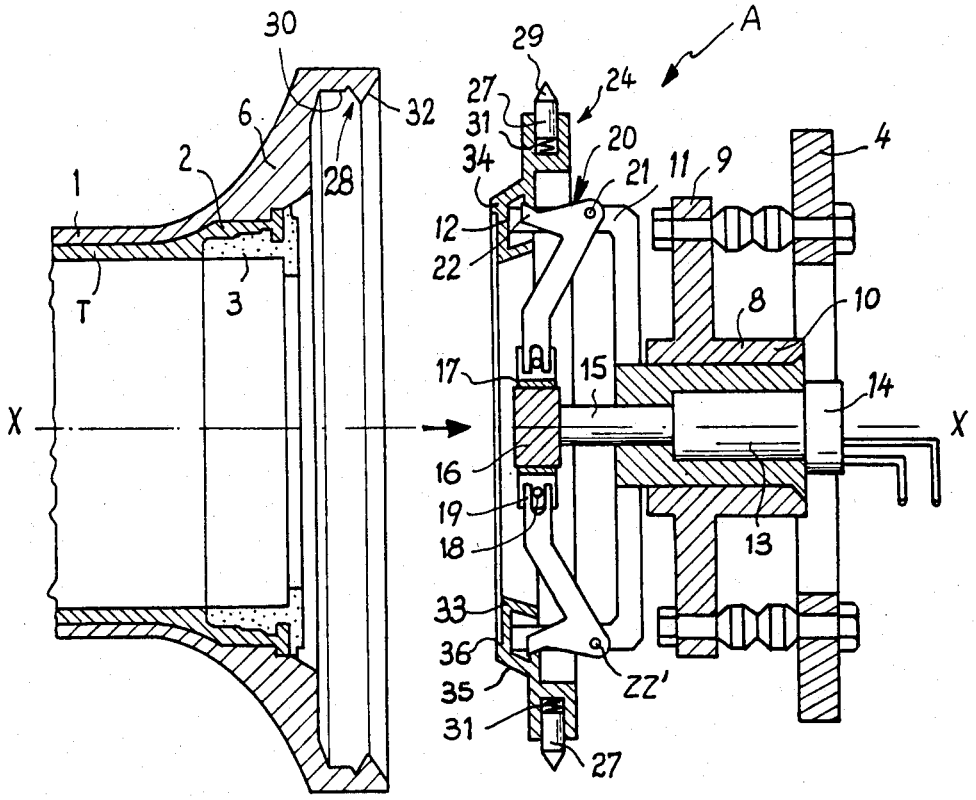
FIG. 7 is an axial sectional view in the same plane as FIG. 5, showing the seat separated from the core and extracted from the end of the chill-mould by the head.

The head assembly A supports a sintered sand socket core 3 for a chill-mould 1 for the centrifugal casting of iron pipes having an end socket 2. The mould 1 revolves around a horizontal axis X—X, and is part of a casting machine B, already known and represented diagrammatically in FIG. 1. Centrifugal casting of pipe T (FIG. 7) is performed in a conventional manner, by axially pouring liquid pig iron inside the mould. The end socket configuration is determined by the annular core 3, situated coaxially in the socket end 6 of the mould by the head assembly A. The latter can be moved by a conventional handling device, such as that described in French patent No. 75/18,770 (publication No. 2,314,790). The head assembly is coupled with such a handling device by ring 4, which forms part of the latter.

Head assembly A includes metal seat 24, arranged to support and hold core 3 in socket end 6 during centrifugal casting, and a head 50 for setting the core and which forms the main part of the head assembly. Seat 24 can be detached from head 50, and has spring-loaded detent mechanisms 27 for automatic fastening to the mould during casting with the head 50 then being detached from the seat.

Figure 6:
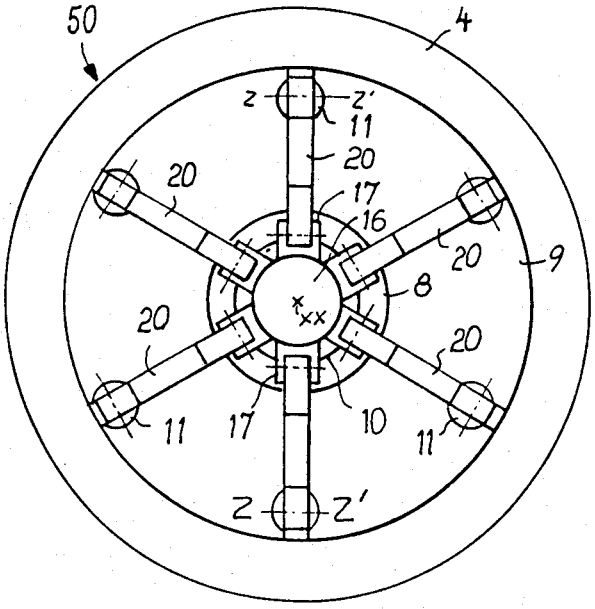
FIG. 6 is a vertical cross-section of the head with its means for gripping the seat and core, in accordance with line VI—VI of FIG. 5.

The gripping and connection means include dogs 20 distributed around the X—X axis, six in the example shown (FIG. 6), and articulated at 21 about axes Z—Z' orthogonal to axis X—X. Dogs 20, spaced at equal angular intervals, are actuated by jack 13 set in floating bearing 8 of head 50. Bearing 8, concentric to jack 13, includes outer ring 9 connected to ring 4 by elastic supports 5, distributed angularly relative to dogs 20. Supports 5, of which there are six in the example described, are held by bolts 7 on axes Y—Y parallel to the X—X axis, and which go through rings 4 and 9. Jack 13 is of the double-action type. It is fed by revolving joint 14, and includes rod 15 equipped with head 16, capable of working with dogs 20 to rotate them around pivots 21 on arms 11 supported by shaft 10, with which they form an integral unit. Each dog 20 thus works with a support arm 11. These arms are distributed around the X—X axis according to the same angular intervals as dogs 20, pivots 21, and axes Z—Z'.

Tubular shaft 10 is disposed between bearing 8 and jack 13, which is thus set inside shaft 10. The arms 11 have a reverse-L profile, whose upper arm, parallel to the X—X axis, terminates in end face 12 for abutting engagement in seat 24 as explained below.

Each articulated dog 20 comprises a lever bent on both sides of pivot 21; each lever includes a part 20*a*, extending radially toward the X—X axis and ending in a fork 19 articulated in a post or cap 17 fixed on the head 16 of the jack rod. Journals 18 are set crosswise in caps 17 and engage the inside of corresponding forks 19 in such a way as to rotate dogs 20 by axial movements of the head 16 and caps 17.

Each dog lever also has a part 20*b*, bent relative to radial part 20*a*, with which it forms an acute angle. This part 20*b* has an end claw 22 for gripping seat 24. Each dog 20 thus has the approximate shape of the numeral 7.

The seat 24 has a generally annular shape, and includes an annular coaxial recess 51 open toward head 50 for receiving the gripping claws 22 of the dogs when they are pivoted by moving head 16 in the direction of arrow F (FIG. 4); i.e., toward the end of socket 6.

Thus, in the advanced position of rod 15 and head 16 (FIGS. 2, 3 and 7), dogs 20 engage and hold seat 24 by claws 22, which bear against an inclined inside rim 23 of recess 51. In the retracted position of head 16, the dogs 20 pivot counter-clockwise which moves the claws away from the support rim 23 (FIG. 4) and unlocks seat 24 from head 50.

The seat 24, on its face opposite recess 51, has a projecting annular ring 34 arranged to fit in a seat 36 with a mating profile formed on socket core 3, to thereby enable the seat 24 to support the core. The seat 24 also has means for fastening to socket 6 during centrifugal casting. These fastening mechanisms comprise detent pins 27 mounted to slide radially around the edge of seat 24, connected to springs 31 which act to retract the pins within the seat. Pins 27 have conical ends 29, arranged to bear against a sloping side 28 of a circular projection 32 of the socket end 6 extending inwardly from a circular groove 30. The conical ends 29 of the pins 27 thus bear against the side 28 of projection 32 during casting by centrifugal forces acting against the counter pull of springs 31, thus locking seat 24 on socket end 6. Seat 24 is thus automatically locked on the socket end as long as the centrifugal forces are greater than the retraction forces of springs 31.

Pins 27 and springs 31 are seated in recesses 26 distributed around the periphery of seat 24. Recess 51 is limited on the X—X axis side by an annular wall 25, forming a truncated skirt flared toward head 50. The function of this wall 25 is to keep liquid metal from being thrown out of the casting machine in the event of an accidental rupture of core 3 during centrifugal casting. Pins 27 can slide along axes P—P orthogonal to the X—X axis. At rest, the conical end points 29 are retracted relative to projection 32, and fit within an imaginary circle of a diameter less than that of the projection.

Finally, outside wall 35 of recess 51 forms a truncated extension of ring 34 which mates with the inner rim of socket end 6, with core 3 resting on an annular support face 33 of seat 24 which forms the bottom of the recess.

Figure 2:
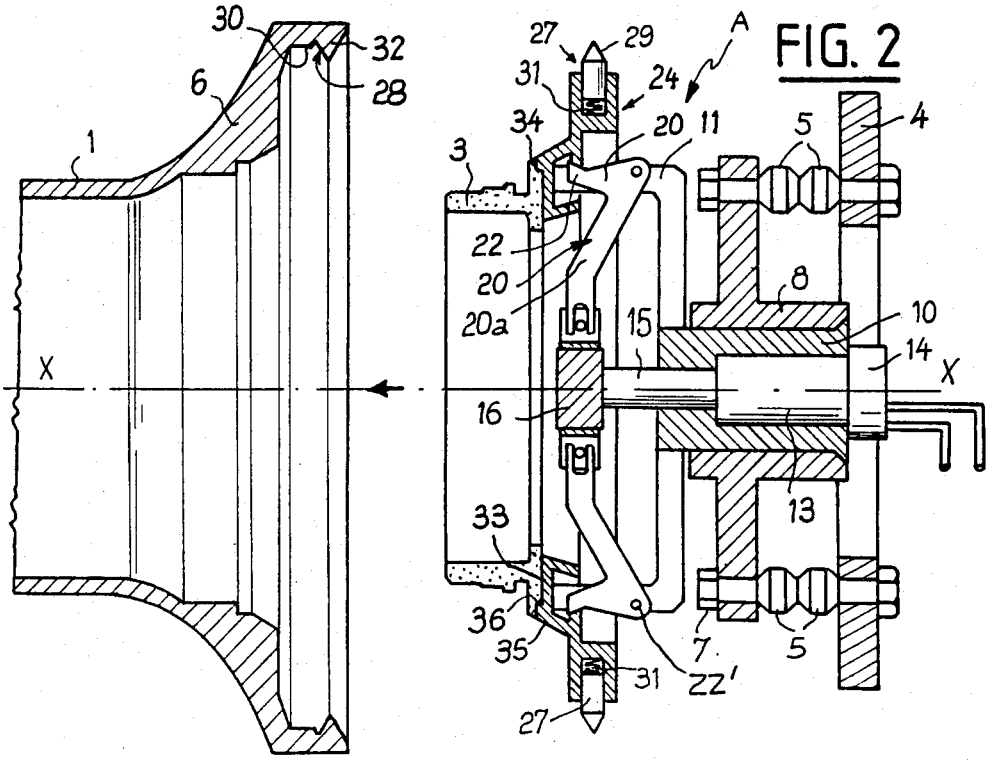
FIG. 2 is an axial, longitudinal sectional view of the core support device, to a larger scale than FIG. 1, before the core is placed into the socket end of the chill-mould.

In operation, the glued or sticky socket core 3 is placed by the operator on support face 33 of seat 24 opposite head 50, such that ring 34 fits into the mating seat 36 (FIG. 2). Seat 24 is locked onto head 50 by dogs 20, whose claws 22 are locked against inner rim 23 by jack 13 as described above.

Figure 3:
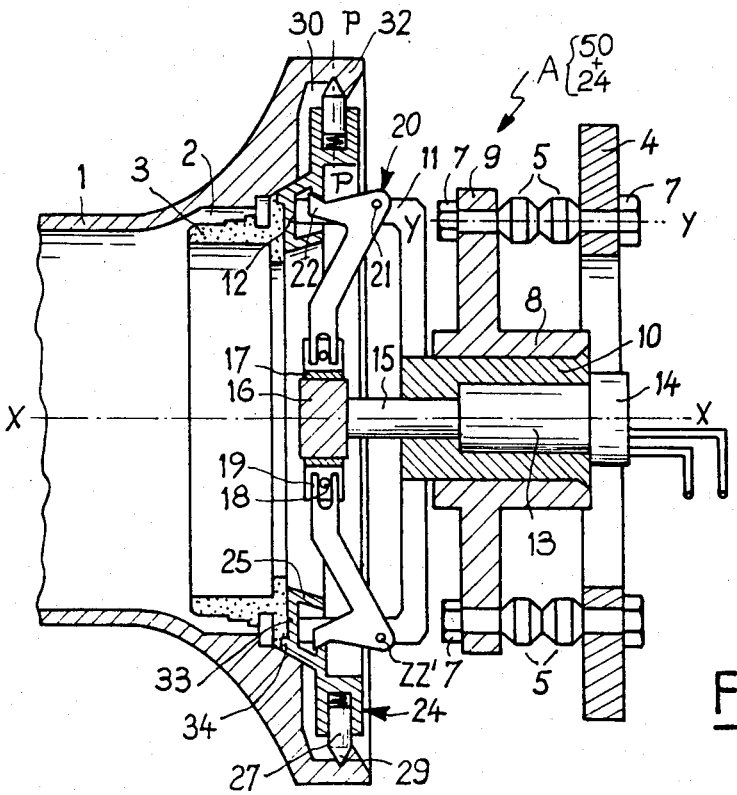
FIG. 3 is an axial sectional view similar to FIG. 2, showing the core support device when the core is put into the socket end of the chill-mould, and before the seat and head are separated.

The head, seat and core assembly is then handled in a conventional manner, not shown, to move the assembly translationally along axis X—X, during which core 3 enters socket end 6 and seat 24 is set into the outer part of this end (FIG. 3). Upon completion of this translation, truncated wall 35 is thus applied against the corresponding inner face of socket end 6, while pins 27 are kept retracted by springs 31.

During this operation of setting the core 3 and seat 24, the chill-mould 1 and its socket end 6 are rotating around axis X—X, and ring 34 and truncated wall 35 center themselves in the socket end due to the flexibility of elastic supports 5, which provide a certain degree of freedom to head 50. When wall 35 and ring 34 come into frictional contact with the inner rim of socket end 6, the integral assembly comprised of core 3, seat 24 and the support, control and locking mechanisms (10, 11, 13, 16 to 22) begins to rotate around axis X—X, with shaft 10 eventually turned inside bearing 8 at the same speed as the chill-mould. As a result, pins 27 are pushed by the centrifugal forces ever further into groove 30, until their truncated ends 29 bear against the interior side 28 of projection 32.

Figure 4:
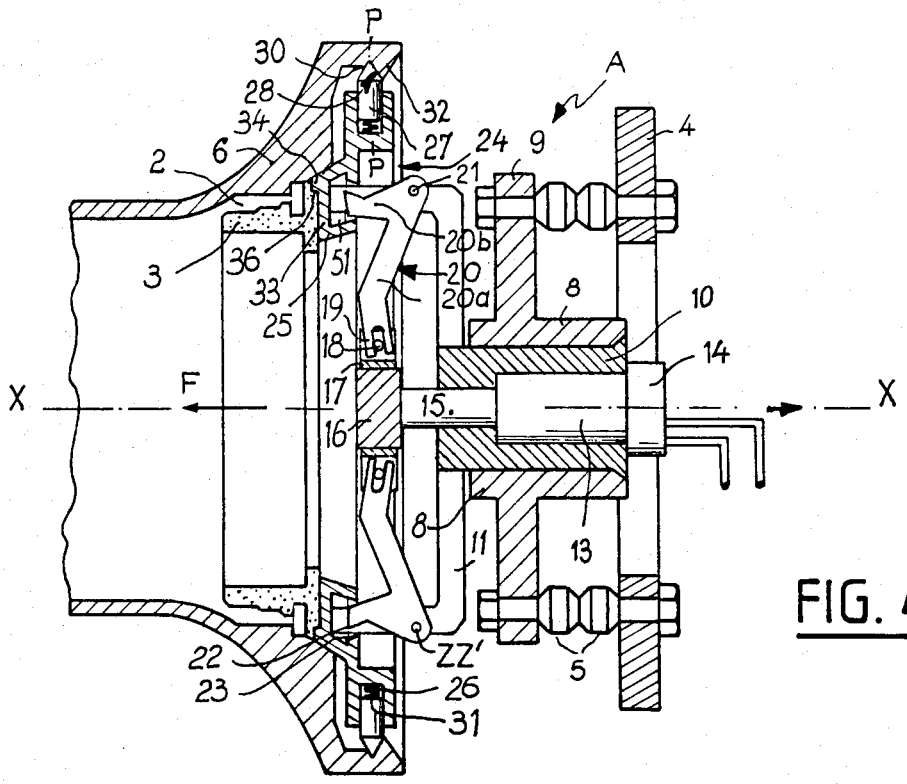
FIG. 4 is an axial sectional view, to a larger scale than FIG. 1, showing the beginning of the operation of separating the seat and head by retracting the connection dogs.
Figure 5:
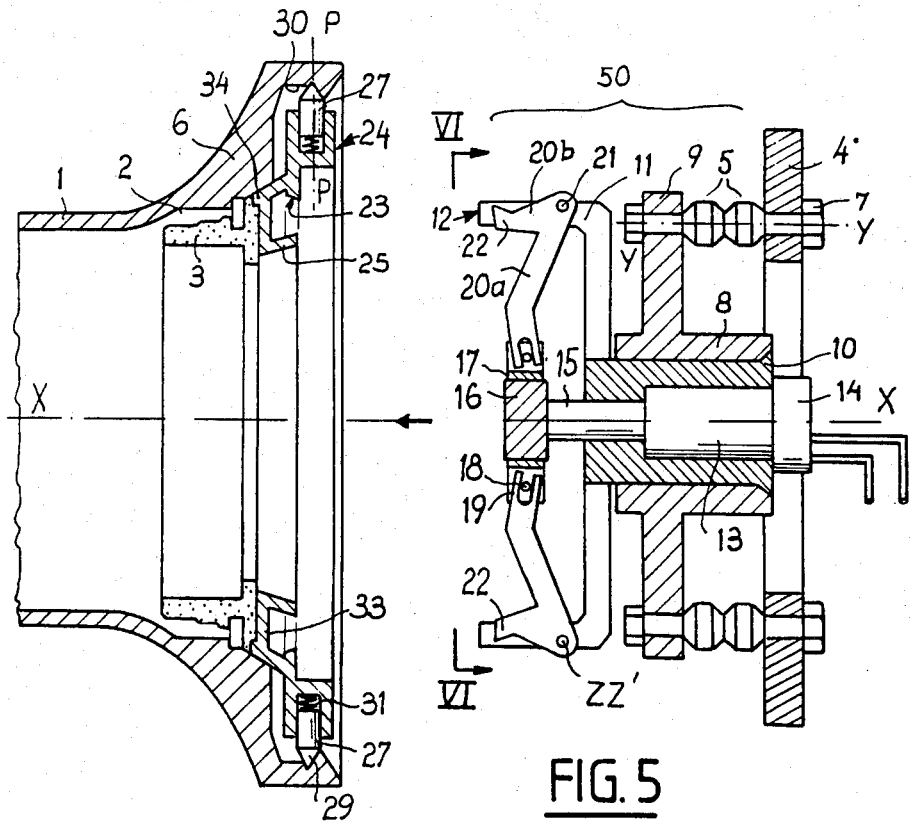
FIG. 5 is an axial sectional view similar to FIG. 2, showing the seat and core placed into the socket end of the chill-mould, before centrifugal casting of the iron pipe, with the head detached from the seat.

When seat 24 is thus locked on socket end 6 by pins 27, rod 15 of jack 13 is retracted which causes dogs 20 to pivot by means of journals 18 sliding in forks 19 (FIG. 4). Claws 22 thus move away from the rim 23, which disengages seat 24 from head 50. The handling mechanism for head 50 mentioned above is then used to separate it from seat 24, with ends 12 of arms 11 then leaving recess 51 (FIG. 5). Head 50 is thus removed from the casting machine B, and pipe T is centrifuged.

When pipe T with its socket 2 formed between end 6 of chill-mould 1 and core 3 (FIG. 7) is cast as an integral unit, head 50 with its claws 22 retracted (FIG. 5) is brought back toward seat 24 and the chill-mould and reengaged with the seat by a procedure reverse to that above, i.e. by moving rod 15 of jack 13 forward to fasten claws 22 in recess 51 with ends 12 of arms 11 again resting against bottom 33 of the recess. Seat 24, whose pins 27 are retracted as the mould rotation slows down, is then axially extracted while the sintered core 3 breaks up and separates from the seat.

Since the head assembly A (50+24) is removed during the extraction of solidified pipe T, seat 24 can be refitted during this operation with a new socket core 3 in preparation for the next casting.

As a result of annular recess 51 of seat 24 and the means for fastening the seat provided by articulated dogs 20 whose claws 22 are arranged to enter and clamp against the recess, a sintered sand socket core 3 can be fitted without directly gripping the core by dogs 20. This thus eliminates any risk of the core being damaged by the dog forces before the centrifugal casting.

Moreover, the automatic locking device of seat 24 on socket end 6, consisting of centrifugal pins 27, enables seat 24 to be separated from head 50 thus allowing visual observation of the casting inside chill-mould 1. This dissociation of seat 24 and head 50 also relieves the equipment used, since head 50 no longer exerts an axial push on seat 24 during casting.

What is claimed is:

1. An apparatus for supporting and positioning a sintered sand socket core (3) in an open end of a horizontally oriented centrifugal chill-mould (1) for casting iron pipes (T), comprising:

(a) an annular metal seat (24) for coaxially engaging and supporting a socket core, (b) a head member (50) disposed coaxially outwardly of the seat with respect to the open mould end, (c) a plurality of dogs (20) mounted on the head member and selectively actuable to directly engage within an accommodating annular coaxial recess (51) defined within the seat to thereby grip and release the seat and enable the positive retention thereof by the head member dogs, and (d) a plurality of mechanisms (27) mounted on the seat for automatically gripping a socket end (6) of the chill-mould, whereby the head member may be engaged with the seat and a socket core mounted on the latter, the head member, seat and socket core assembly positioned proximate and within the socket end of the mould, the seat gripped to said socket end, and the head member released and withdrawn from the seat to enable centrifugal casting, (e) wherein the dogs are distributed around a longitudinal axis (X—X) of the seat and head member, articulated around axes (Z—Z') orthogonal to the said longitudinal axis, and are actuated by a jack (13) coaxially mounted on the head member, (f) wherein the annular coaxial recess (51) receives end claws (22) of the dogs, and (g) wherein the dogs are articulated on arms (11) supported by a shaft (10) concentric to the jack, ends (12) of said arms bearing against a bottom (33) of the seat recess when the head member is engaged with the seat, and ends of the dogs remote from the class comprise forks (19) articulated in posts (17) fixed on a head (16) of a rod (15) of the jack.

2. Apparatus according to claim 1, wherein each dog comprises a lever bent on both sides of a pivot joint (21) on a corresponding arm.

3. Apparatus according to claim 1, wherein a side of the seat facing the core has a projecting peripheral skirt ring (34) engageable with a matingly configured groove (36) of a core (3) to enable the seat to support the core.

4. Apparatus according to claim 1, wherein the gripping mechanisms comprise inwardly biased, centrifugally extended detents radially mounted around the outer periphery of the seat.

* * * * *